United States Patent [19]

Herzog et al.

[11] 4,175,902

[45] Nov. 27, 1979

[54] APPARATUS FOR LOADING AND UNLOADING RAILROAD CARS

[75] Inventors: Stanley M. Herzog; Randy L. Poggemiller, both of St. Joseph, Mo.

[73] Assignee: Herzog Contracting Corporation, St. Joseph, Mo.

[21] Appl. No.: 903,177

[22] Filed: May 5, 1978

[51] Int. Cl.[2] ..... B65G 67/24

[52] U.S. Cl. ..... 414/339; 280/764; 414/394

[58] Field of Search ..... 414/333, 339, 394, 395, 414/503, 786; 280/764

[56] References Cited

U.S. PATENT DOCUMENTS

| | | | |
|---|---|---|---|
| 1,263,170 | 4/1918 | Webb | 414/394 X |
| 1,361,832 | 12/1920 | Crilly | 414/394 X |
| 1,678,245 | 7/1928 | Dickinson | 414/339 X |
| 2,801,014 | 7/1957 | Colson | 214/520 |
| 3,107,803 | 10/1963 | Glosup | 214/520 |
| 3,329,289 | 7/1967 | Fritz | 214/44 |
| 3,376,988 | 4/1968 | Klosk | 214/515 |
| 3,881,612 | 5/1975 | Wells | 414/394 |
| 4,096,954 | 6/1978 | Buckner | 214/38 CC |
| 4,099,635 | 7/1978 | Leonard | 214/152 |
| 4,128,180 | 12/1978 | Mellious | 414/339 |

*Primary Examiner*—Stephen G. Kunin
*Assistant Examiner*—Terrance L. Siemens
*Attorney, Agent, or Firm*—Fishburn, Gold & Litman

[57] ABSTRACT

A mobile, wheeled apparatus is employed for loading and unloading an open top or gondola railroad car and has power actuated front and rear boom structures. A front supportive foot engageable with the upper surfaces of the railroad car sidewalls is connected to free ends of the front boom structure and similarly engageable rear supportive feet are connected to the ends of outrigger arms movable outwardly from the sides of the rear end of the mobile apparatus. The rear boom structure includes an articulated material engaging grapple for loading and unloading operations. During operation, the operator positions the mobile apparatus adjacent an end of the railroad car with the front boom raised and the front supportive foot engaged with the top surfaces of the car sidewalls. By coordinated use and operation of the front and rear boom structures and the material grapple, the mobile apparatus is raised above the railroad car walls and moved forwardly until the front and rear supportive feet engage with the side wall upper surfaces. Then, the rear boom and material handling grapple is used to load and unload materials relative to the railroad car. The mobile apparatus is also capable of transfer from one railroad car to another in a train thereof by coordinated use of the front and rear boom structures.

10 Claims, 11 Drawing Figures

APPARATUS FOR LOADING AND UNLOADING RAILROAD CARS

This invention relates to an apparatus for handling materials and particularly to a mobile apparatus for loading and unloading open top railroad cars.

Unloading operations have been accomplished by mobile cranes and the like positioned along a track outside of the railroad car track. However the unloading operations may be along a track far from a depot, yard or other facility where cranes may be used for such unloading operations and any equipment used must be transported to such a site. Therefore, the handling of materials such as crossties and railbed ballast has heretofore been accomplished either by manual labor or by the use of methods employing relatively expensive and complex devices specifically designed for such use. The use of hand labor is, of course, normally costly and is inordinately time-consuming. Alternatively, a specifically designed material handling apparatus quite often requires a considerable capital expenditure which ties funds to equipment having a relatively limited purpose and without reasonable possibilities of adaption for other construction requirements and material handling uses.

The present invention overcomes the above deficiencies and provides a material handling mobile apparatus for unloading and loading open top, or gondola railroad cars in a relatively quick and efficient manner and which needs no ramps, cranes, or the like to position itself on top of the cars for material handling operations. Rather, the apparatus includes brackets or feet for supportive engagement with upper surfaces of the car sidewalls and is able to climb atop the car sidewalls from a position on the ground adjacent an end of the car. A conventional and relatively low cost mobile apparatus is employed which is quickly and easily converted from a normal use configuration to a railroad car engaging configuration for loading and unloading operations.

Such a relatively conventional structure provides the advantages of requiring a significantly low capital investment as well as permitting required types of equipment to be kept to a minimum. For example, where construction and material handling is to be conducted at a remote site, only a few items of equipment, including the present apparatus need be transported to the site. After the use of the same to unload railroad cars containing, for example, crossties and ballast for rail bed construction, the means for engagement with the car side walls may be easily removed and conventional members connected thereto, thereby converting the apparatus for normal digging, trenching, and ground material handling operations.

In view of the above, the principal objects of the present invention are: to provide a mobile apparatus for loading and unloading an open top container structure such as a railroad gondola car; to provide such mobile apparatus having support members for engagement with the upper surfaces of the spaced, parallel side walls of a gondola car; to provide such a mobile apparatus which is similar in configuration to a tractor having a loader arm and digging bucket on the front end thereof and an articulated boom with a back-hoe bucket, clam shell digger, grappling members or other material handling and lifting devices on the rear end thereof; to provide such a mobile apparatus including an articulated boom structure having a selected material handling device connected thereto; to provide such a mobile apparatus which is positionable on the ground adjacent a railroad car and is able to climb from the ground to atop the sidewalls of the car; to provide such a mobile apparatus which is readily convertible to a conventional material handling apparatus for extensive ground operations; to provide such a mobile apparatus which is suitable for a multitude of material handling and construction operations; to provide such a mobile apparatus having power actuated front and rear boom structures of such respective lengths to reach below the ground surface and above the railroad car side and end walls when positioned on the ground therealong; to provide such a mobile apparatus which has a rear boom structure which can be swung from one side to another of the railroad car to accomplish loading and unloading operations; to provide such a mobile apparatus having means moving the apparatus longitudinally along the side walls of the railroad car while accomplishing material loading and unloading operations; and to provide such a mobile apparatus which is relatively inexpensive, sturdy and efficient in use, and particularly well adapted for its intended purpose.

Other objects and advantages of this invention will become apparent from the following description taken in connection with the accompanying drawings wherein are set forth by way of illustration and example, a certain embodiment of this invention.

Figure 1:
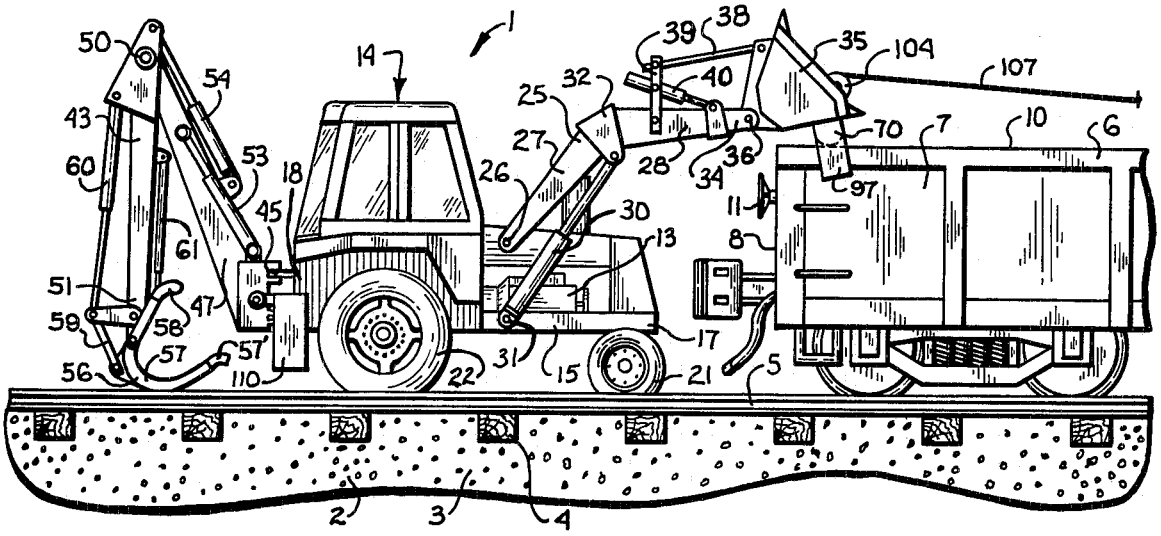
FIG. 1 is a side elevational view illustrating a mobile apparatus positioned adjacent to a railroad car.

Referring more in detail to the drawings:

As required, a detailed embodiment of the present invention is disclosed herein, however, it is to be understood that the disclosed embodiment is merely exemplary of the invention which may be embodied in various forms. Therefore, specific embodiments disclosed herein are not to be interpreted as limiting, but merely as a basis for the claims and as a representative basis for teaching one skilled in the art to variously employ the present invention in connection with virtually any appropriately detailed structure.

The drawings are particularly related to an apparatus which is adapted for unloading gondola type railroad cars. It will become apparent from the following description that the apparatus is capable of use with any appropriately configured open container, not only including gondola cars but also elongate open tanks, flat bed cars, and the like.

In general overview, the apparatus is mobile and includes a wheel supported frame having an arm or boom pivotally mounted at one end for up and down swinging movement, a support or foot member pivotally mounted on a free end of the boom for engaging the upper surface of the side walls of an open railroad car and retaining the apparatus front end thereon and power means operably connected to the arm and foot members for selectively moving same relative to the frame. The frame has an articulated boom mounted at the rear end for up and down and side to side swinging movement and has a free end having a material engaging device pivotally connected thereto. Outrigger arms are pivotally mounted to the frame sides adjacent the rear end thereof and have feet for engaging the upper surface of the side walls and retaining the apparatus rear end thereon. An operator's seat is mounted on the frame is proximity to controls whereby the operator may selectively effect movement of the front boom, front supportive foot, rear articulated boom and material engaging device, outrigger arms and rear supportive feet and to move the apparatus and position same.

More in detail, the reference numeral 1 indicates generally an apparatus used for unloading and loading container cars. The apparatus includes a combination back-hoe tractor which, prior to configuration thereof as described below, is of the type commonly used in construction and material handling operations and is depicted positioned on a railroad bed 2 comprised of a built-up base of gravel or ballast 3 over which crossties 4 are laid. Rails 5 are mounted on the crossties 4, thereby forming a section of railroad track. The apparatus 1 is used for loading and unloading an elongate gondola car 6 which, as is conventional, includes spaced, parallel, upright side walls 7 joined to opposite end walls 8 and 9 and having spaced, parallel upper surfaces 10 extending therearound. A handle 11 is operably connected to the brakes of the gondola car 6 which prevent undesired and inadvertent rolling thereof, such as during positioning of the apparatus 1 atop the side walls 7 of the car 6.

The apparatus 1 includes an engine or other power device generally at 13, an operator's cab 14 having a seat and suitable power and operating controls therein and a frame 15 having opposite front and rear ends 17 and 18. The apparatus 1 is wheel mounted, and includes front and rear pneumatic tires 21 and 22 connected to axles (not shown) attached to the frame 15 for providing movement over the ground surface. A pair of front boom arms 25 are mounted at pivot points 26 to front end portions of the apparatus 1 for up and down swinging movement and include respective joined pairs of arm sections 27 and 28. The front boom arms 25 are of such a length to reach below the ground surface and above the railroad car side and end walls 7, 8 and 9 when the apparatus 1 is positioned on the ground. Movement is provided by motive means, such as hydraulic cylinders 30 having one end thereof connected to a joint 32 interconnecting the arm sections 27 and 28 and having the other end thereof connected to a pivot 31 on the frame 15 and spaced from the boom pivot 26 for the up and down swinging action thereof.

In the illustrated example, the arm sections 28 have respective free ends 34 connected to a selected earth engaging and material handling device or tool, such as a bucket 35 or the like. The bucket 35 is hingedly connected to the free ends 34 by pins 36 permitting limited forward and rearward tilting movement and is controlled for rotational movement by respective linkage arms 38 pivotally connected to each other and forming a parallelogram-shaped structure in coordination with the arm sections 28 and the bucket 35. Side arms 39 are pivotally connected to second hydraulic cylinders 40 which are also connected to portions of the arm sections 28 spaced from the side arms 39 for effecting movement thereof and movement of the bucket 35 by drawing the same forwardly and rearwardly. The cylinders 30 and 40 are connected by suitable conduits and hoses to hydraulic power means which are associated with the engine 13 and which are controlled by suitable means located in the operator's cab 14.

An articulated, rear boom structure 43 is connected to the rear end 18 and is pivotally movable from side to side and movable for up and down swinging movement relative to the frame 15. As used herein, the phrase "rear boom structure" includes not only a boom connected to the rear end portions of the apparatus 1 but also a boom connected to other portions of the apparatus 1 and which is movable into a rearwardly extending position.

In the illustrated example, the rear boom structure 43 has vertically spaced ear members connected to coordinating vertically spaced ear members on the rear end 18 at upper and lower pivot points 45 for horizontal swinging motion. Suitable power means for effecting rotation, such as a hydraulic ram or rotary motor 46 is operably connected thereto. The rear boom structure 43 is connected thusly to the frame rear end 18 and has a pair of arm sections 47 and 48 foldable relative to each other and interconnected at a joint 50. The arm section 48 includes a free end 51. The arm sections 47 and 48 are of a combined length to reach the ground when the mobile apparatus 1 is positioned atop the side walls 7 of the railroad car and to reach above the same when the mobile apparatus 1 is positioned on the ground adjacent the railroad car. A hydraulic cylinder 53 is pivotally connected to the arm section 47 for folding the same relative to the apparatus end 18. Additionally, a hydraulic cylinder 54 pivotally connecting a portion of the joint 50 and the arm 47 permits folding of the arm section 48 relative to the arm section 47.

The free end 51 of the arm section 48 is capable of accepting a selected material engaging and/or earth engaging device or tool such as a bucket, clamshell digger and the like, and in the illustrated example, a material grapple 56 is connected thereto. The exemplary grapple 56 has curved claws 57 with ends or tips 57' and an opposing thumb structure 58 connected to a hydraulic cylinder 61 also connected to the arm section 48 and is operable to grasp and lift objects, such as the crossties 4. Accordingly, linkage arms 59 are pivotally connected to the claws 57 and are actuated by a hydraulic cylinder 60 connecting the joint 50 and the linkage arms 59. Together, the linkage arms 59 and the hydraulic cylinder 60 cooperate to longitudinally pivot the grapple 56 between a curled under position extended toward the apparatus rear end 18, and an extended position reaching away from the rear end 18. Here too, the hydraulic cylinders 53, 54, 60 and 61 are connected by suitable hose means (not shown) to a hydraulic power means associated with the engine 13.

Figure 5:
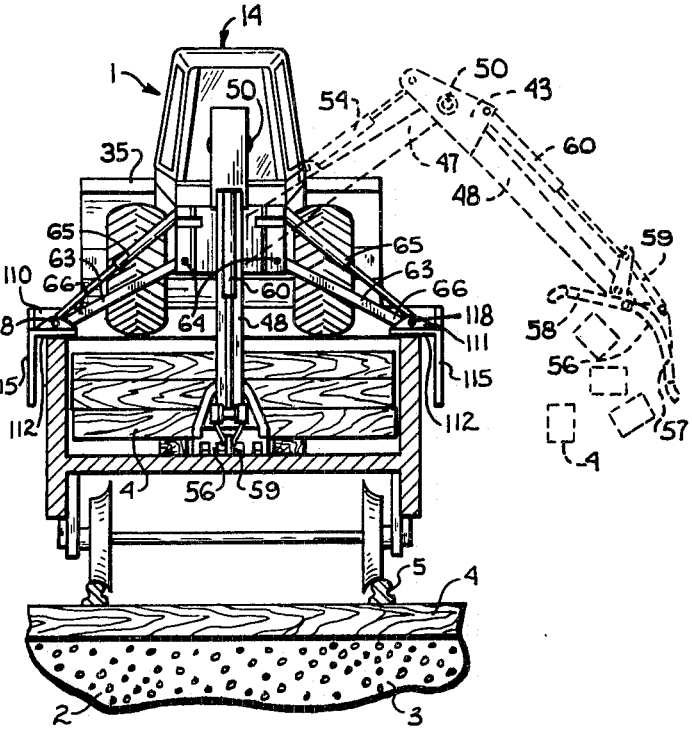
FIG. 5 is a cross-sectional view of the rear of the apparatus upon the railroad car and performing unloading operations and illustrating rear support feet thereof.
Figure 6:
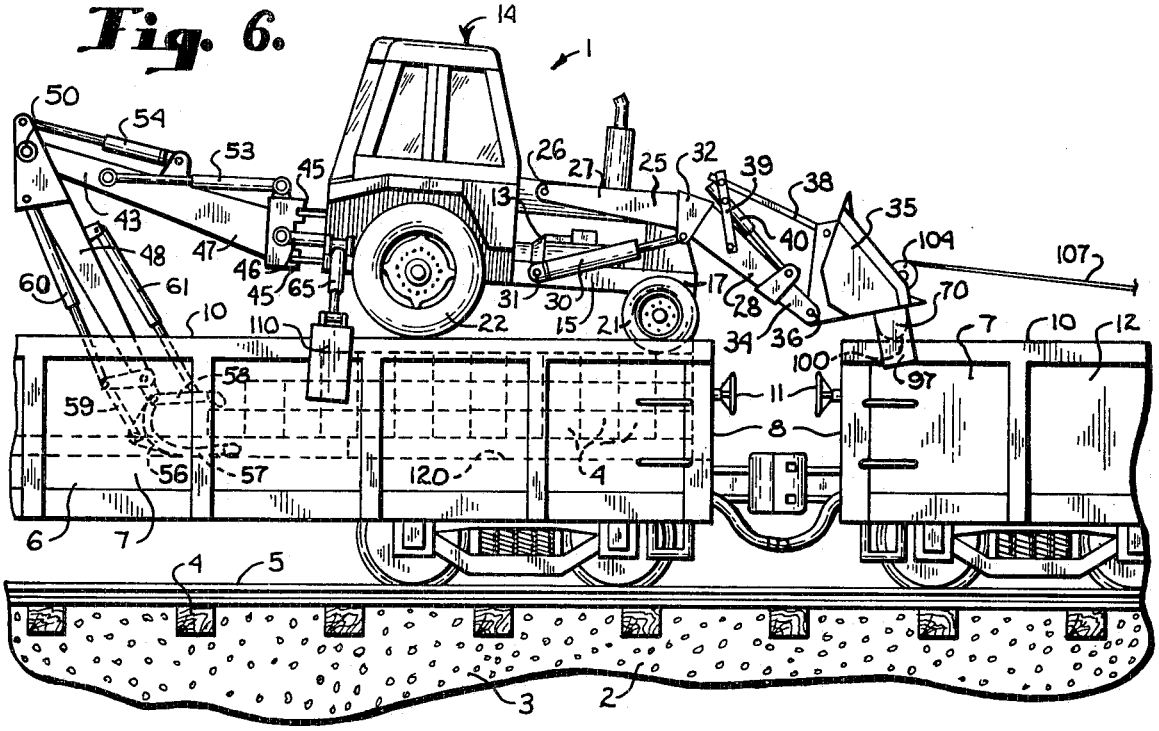
FIG. 6 is a side elevational view similar to FIG. 3 and showing the apparatus in transfer sequence between a first car and a second car.
Figure 7:
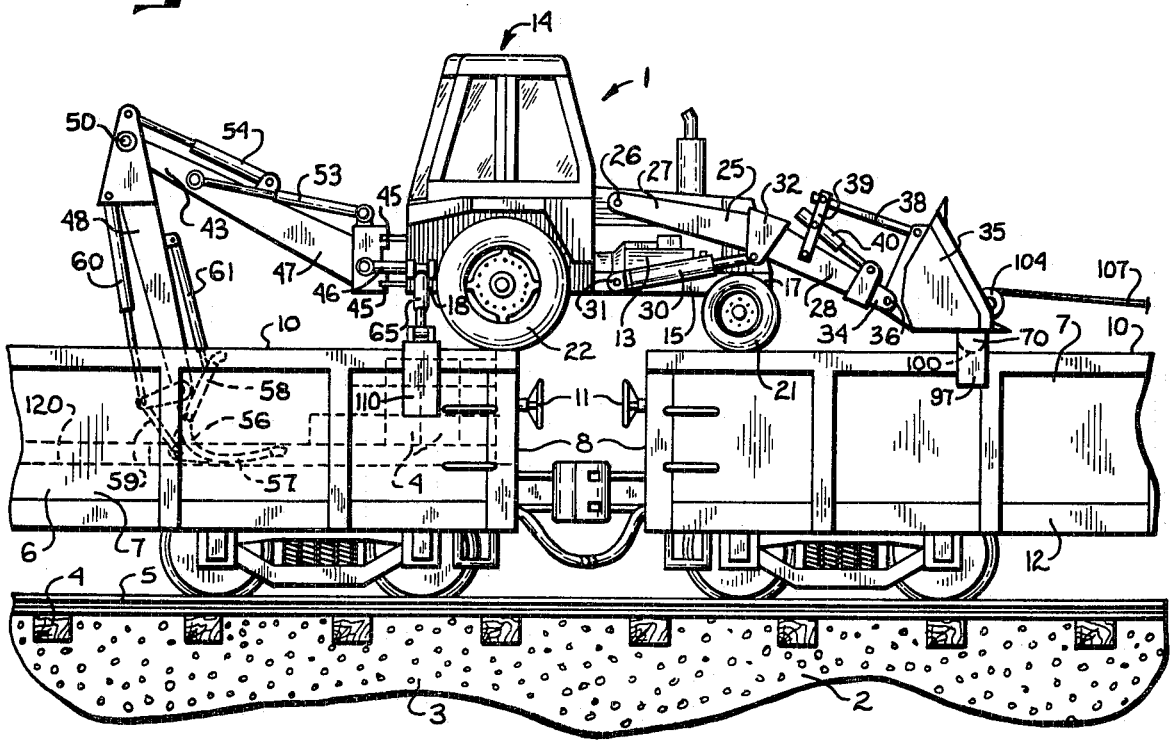
FIG. 7 is a side elevational view similar to FIG. 6 and illustrating the apparatus having a front support foot engaged with the sidewall upper surfaces of a second car and its rear support feet engaged with the sidewall upper surfaces of a first car and the mobile apparatus straddling the separation between the cars.
Figure 8:
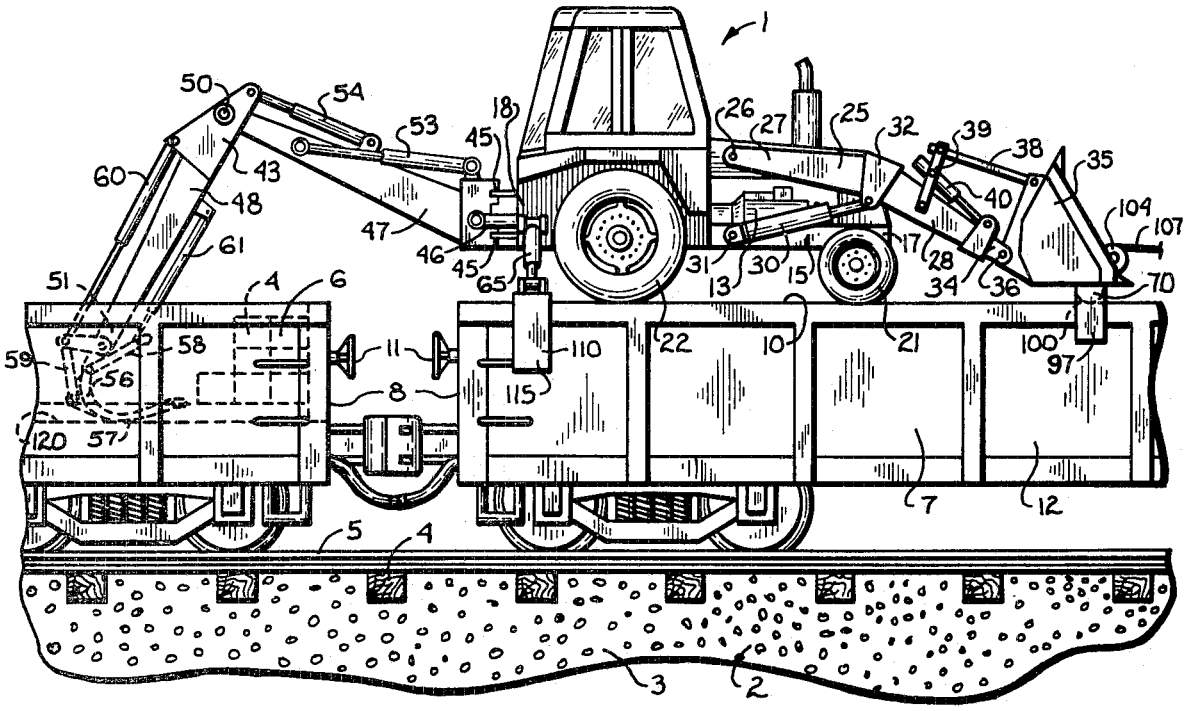
FIG. 8 is a side elevational view showing the mobile apparatus atop the side wall upper surfaces of a second railroad car and using its rear boom structure to load and unload materials into the first car.
Figure 9:
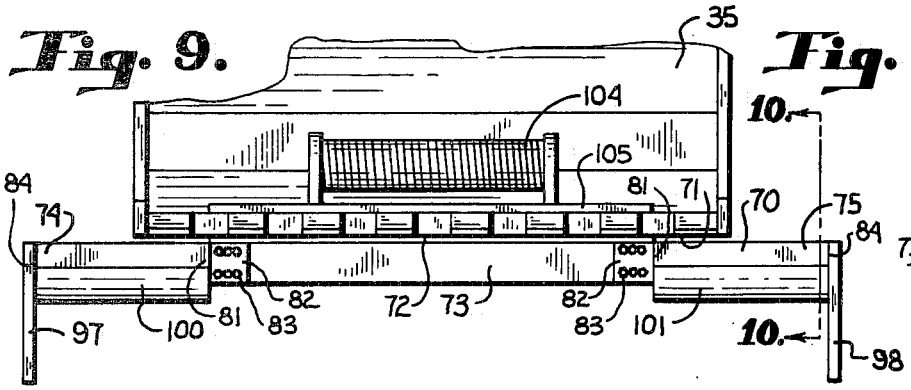
FIG. 9 is an enlarged fragmentary, front elevational view of a front boom structure bucket and a front support foot connected thereto and including a winch mounted in the bucket.
Figure 10:
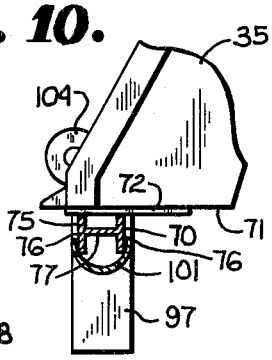
FIG. 10 is a enlarged sectional view taken along lines 10—10, FIG. 9 and showing the front portion of the bucket and front support foot.
Figure 11:
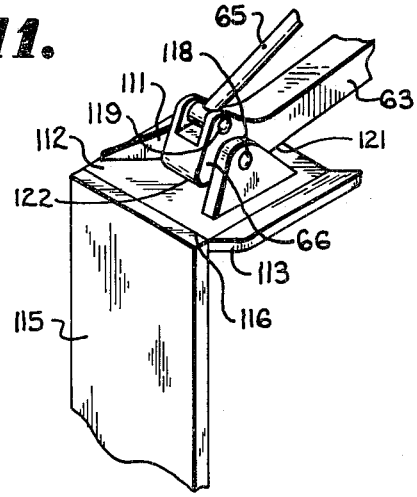
FIG. 11 is an enlarged perspective, fragmentary view of an outrigger arm structure having one of the rear support feet connected thereto.

The mobile apparatus 1 further includes a pair of power actuated foldable outrigger arms 63, FIG. 5, connected for up and down, or inward and outward, swinging movement at pivots 64 to the frame sides adjacent the rear end 18 and operated by respective hydraulic cylinders 65 extending between arm free ends 66 and the frame 15.

Figure 4:
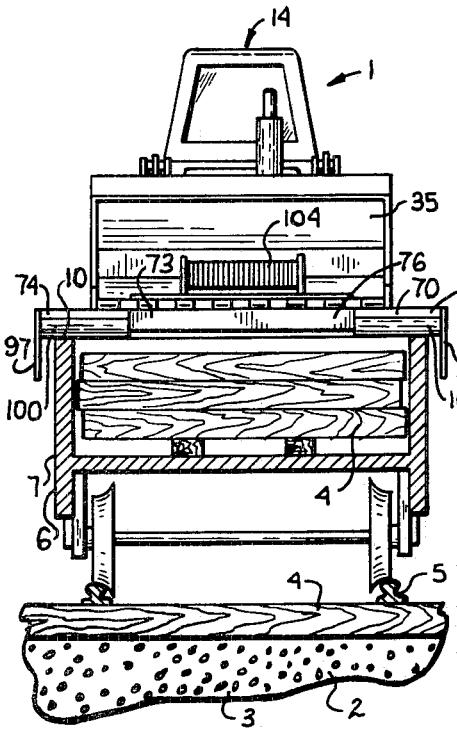
FIG. 4 is a cross-sectional view of the front of the apparatus engaged upon the upper surface of the side walls of the railroad car and illustrating a front support foot thereof.

For positioning the mobile apparatus 1 atop the gondola car 6, front and rear mounting means adapted for engagement with the upper surfaces 10 of the spaced, parallel, side walls 7 thereof are attached to respective portions of the mobile apparatus 1. As best illustrated in FIG. 4, a front supporting bracket or foot 70 is mounted parallely to the bottom 71 of the bucket 35 and spaced slightly therefrom by an elongate plate 72. The front supportive foot 70 includes an elongate beam 73, such as an H beam, having a pair of spaced parallel flanges 76 connected by a web 77 extended normally therebetween. The beam 73 is of lesser length than the bucket 35 and has H-beam end portions 74 and 75 connected thereto which extend beyond the bucket margins a sufficient distance to project transversely across the upper surfaces 10 of the railroad car side walls 7.

The end portions 74 and 75 are detachably connected to the beam 73 for removal therefrom when it is desired to transport the mobile apparatus 1 on public roads, where typically, highway regulations set a maximum width of eight feet for articles transported thereon. In the illustrated example, respective inward portions 81 of the end portions 74 and 75 are connected to front and rear plates 82 which fit parallely against parts of the flanges 76 of the beam 73. A plurality of elongate fasteners 83, such as bolts, extend through aligned bores (not shown) through the plates 82 and the flanges 76 of the beam 73 and thereby rigidly and removably connect the end portions 74 and 75 to the beam 73.

To a limit lateral sliding of the front support bracket 70 when the mobile apparatus 1 is positioned atop the gondola car 6, elongate, planar arms 97 and 98 are normally connected to outer edges 84 of the end portions 74 and 75 and extend downwardly therefrom a sufficient distance to slidingly engage the outer surfaces of the railroad car side walls 7 and act as guides for keeping the mobile apparatus 1 substantially longitudinally aligned therewith. To promote longitudinal sliding of the front supportive foot 70 along the upper surfaces 10, as described below in connection with the operation of the apparatus 1, rounded bottom members 100 and 101, such as of longitudinally halved pipe sections, are affixed to the bottom of the flanges 76 in the end portions 74 and 75 and facilitate rolling thereof during tilting of the bucket 35 and for slidingly engaging the upper surfaces 10.

Preferably, a winch means is connected to the apparatus 1 and is operable to longitudinally draw the same along the upper surfaces 10 of the side walls 7 when the apparatus 1 is positioned thereon. This may be a portable winch having the winch body thereof positioned remotely from the apparatus 1 or can be, as in the illustrated example, a revolving reel-type winch 104 mounted within the interior of the bucket 35. In the illustrated example, the winch 104 is secured to a plate 105 mounted onto the top surface of the bucket bottom 71 for additional structural rigidity. The winch 104 contains a quantity of cable or line 107 having a free end (not shown) capable of attachment to a point longitudinally aligned with the mobile apparatus 1 and remotely positioned therefrom.

Rear supportive feet 110 and 111, as does the front supportive foot 70, engage the upper surfaces 10 of the railroad car side walls 7 when the mobile apparatus 1 is positioned atop the railroad car. In the illustrated example, the rear supportive feet 110 and 111 respectively include side wall upper surface engaging planar pad members 112 which are pivotally connected by pins 118 to free ends 66 of each outrigger arm 63 for limited swinging movement toward and away from the frame 15. The connection of the pins 118 is below a pin 119 pivotally connecting the arm free end 66 and the outer end of the hydraulic cylinder 65. It will be appreciated that swinging movement of the planar pad members 112 is limited by the restricting surfaces of the lower surface 121 of the arm 63 immediately inward of its free end 66 and by an upwardly inclined surface 122 of the free end 66 immediately outward of the connecting pin 118.

The respective pad members 112 have upturned ends 113 facilitating forward sliding of the rear support brackets 110 and 111 on the car rails 10. Downwardly extending arms 115 are normally connected to pad edges 116 and engage the walls of the sidewalls 7 to limit lateral movement of the pad members 112 when the rear supportive feet 110 and 111 are engaged with the upper surfaces 10.

As described above, the front supporitve foot 70 and the rear supportive feet 110 and 111 provide engagement means for removably positioning the apparatus 1 atop the side wall upper surfaces 10 and then using the rear boom structure 43 for loading and unloading the gondola car 6. To position the mobile apparatus 1 thusly, the operator seated within the cab 14 drives the apparatus 1 onto the railroad bed 2 and into longitudinal, end-to-end position with gondola car 6. The driver raises the front boom arms 25 and tilts the bucket 35 forwardly. Then the driver positions the apparatus 1 sufficiently close to the car end 8 so that the front boom arms 25 extend thereover, FIG. 1.

Line 107 may be withdrawn at this time from the winch 104 and the free end thereof attached to a suitable anchoring point longitudinally and remotely spaced from the car end 8, although the use of the winch 104 is not required for the operation of the invention and the line 107, if desired, may be extended and anchored after the apparatus 1 is positioned on the side walls 7. Such an anchor may include the opposite car end 9 or, if the car 6 is the near end car of a train of cars, may include suitable anchors on other cars.

Next, the operator positions the rear boom structure 43 in longitudinal alignment with the apparatus 1 and rearward of the rear end 18. The rear boom structure 43 is folded as much as possible and the grapple 56 curled under and toward the apparatus 1 until the grapple 56 is positioned adjacent the rear end 18. The rear boom arm 43 is then lowered until the outside surface of the material handling device, such as the curved grapple claws 54, engages the ground of the railroad bed 2 adjacent the rear end 18, FIG. 1, and thereby transfers upward and lifting force to the rear end 18. The operator coordinately tilts the bucket 35 forward and lowers the front boom arms 25 until the ends 74 and 75 of the front supportive feet 70 engage and rest upon upper surfaces 10 of the parallel 7 and exert upward lifting force on the apparatus front end 17.

It will be apparent that in operation, as illustrated in FIG. 1, the apparatus 1 is braced against the top of the gondola car 7 at its front end 17 and against the ground at its rear end 18, the rear boom structure 43 being folded and the front boom arms 25 being raised. Next, in preparation for positioning the apparatus 1 atop the car side walls 7, the operator swings the outrigger arms 63 outwardly until the rear supportive feet 110 and 111 are appropriately spaced for the distance between the spaced side walls 7 for engagement thereon. To elevate the apparatus 1, the operator actuates the appropriate power controls to lower the front boom arms 25, pressing downwardly on the car side walls 7, and to simultaneously unfold the rear boom arm 43, pressing against the ground, and thereby raising the apparatus 1 without aid from platforms, ramps, external lifting devices, and the like.

Figure 2:
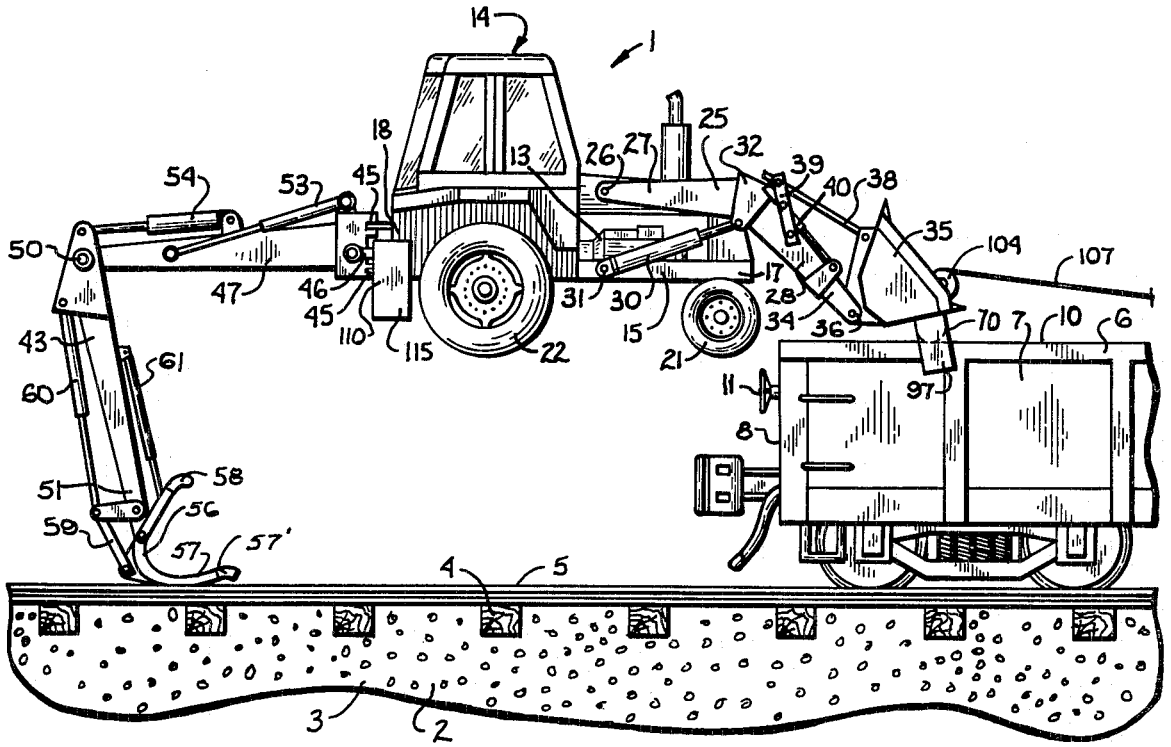
FIG. 2 is a side elevational view similar to FIG. 1 and showing the apparatus elevating itself above the railroad bed.
Figure 3:
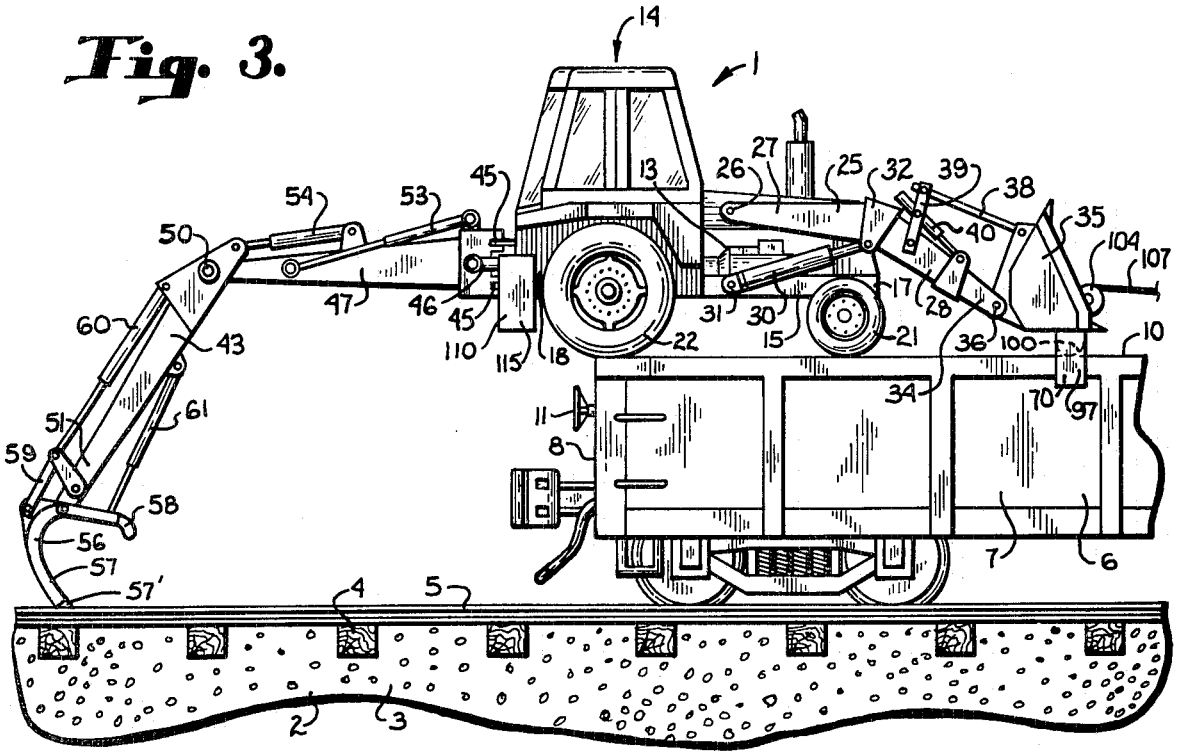
FIG. 3 is a side elevational view similar to FIG. 2 and illustrating the apparatus partly in position atop the upper surfaces of the sidewalls of a railroad car.

As best shown in FIG. 2, the operator raises the apparatus 1 to an elevation preferably slightly above and at least level with the upper surfaces 10 so that the apparatus 1 can be moved forwardly and positioned atop the side walls 7. By manipulation of the hydraulic cylinder controls to the rear boom structure 43 and through coordinated use of the winch 104, if desired, to draw the line 107 inwardly the operator further unfolds the rear boom structure 43 moves the apparatus 1 toward the car end wall 8. Concurrently, the operator rotates the bucket 35 rearwardly on the curved bottom members 100 and 101 and, in the illustrated example, fully raises the grapple 56 forwardly onto the claw tips 57', FIG. 3, to move the apparatus 1 forwardly until the rear tires 22 slide over the end wall 8.

Depending on the starting distance between the apparatus 1 and end wall 8, the initial bite or position of the rear boom arm 43 may be sufficient so that, once the rear boom structure 43 and the grapple 5 is fully extended rearwardly, the rear support feet 110 and 111 engage the end of the side walls 7 and support the apparatus 1 thereon. However, should the initial positioning of the apparatus 1 on the ground not be sufficiently close to the end wall 8 and the rear tires only extend slightly past the end wall 8 and engage same to support the apparatus 1, the rear boom structure 43 is then partly folded and retracted, and repositioned engaging the ground close to the end wall 8. The rear boom structure 43 is again unfolded to lift the rear end 18 and move the front support foot 70 forwardly along the upper surface 10 until the rear supportive feet 110 and 111 engage the spaced upper surfaces 10 and thereby support the apparatus 1 on the side walls 7. Adjustment of the outrigger arms 63 outwardly or inwardly is then accomplished to engage the lateral movement limiting arms 115 with the side walls 7.

Once the apparatus 1 is atop the gondola car 6, movement along the upper surfaces 10 of the side walls 7 is accomplished by alternately folding the rear boom structure 43 and engaging the car bottom surface 120 adjacent the rear end 18 and then unfolding the same to slide the front and rear supportive feet 70, 110 and 111 along the upper surfaces. Alternatively, the apparatus 1 can be moved by actuating the winch 104 to draw the line 107 inwardly and thereby pull the apparatus 1 along the upper surfaces 10.

Once atop the gondola car 6, the rear boom structure 43 is used to load or unload materials relative to the car 6. For example, crossties 4 contained within the car 6 are grasped by use of the grapple 56 and deposited along the railroad bed 2 adjacent the gondola car 6 as desired. Alternatively, materials positioned beside the railroad bed 2 and within range of the rear boom structure 43 can be lifted into the gondola car 6 and discharged thereinto during loading operations.

Handling materials as described above, the apparatus 1 is moved the length of the gondola car 6 until the opposite end wall 9 is reached. The apparatus 1 is capable of moving itself from one car 6 into an adjoining car 12 in a train thereof. To accomplish this, the operator moves the apparatus 1 as close to the end wall 9 as possible The operator then raises the front boom arms 25, thus lowering the front tires 21 until the same rest upon a supportive surface comprising, in the illustrated example, materials contained within the car 6, such as crossties 4. If the car interior adjacent the end wall 9 is empty, sufficient materials should be previously placed therein to support the front tires 21. The bucket 35 is raised and the apparatus moved forwardly in the car until the front boom arms 25 and the front supportive foot 70 extend over the front end wall 8 of the adjoining gondola car 12. The bucket 35 is tilted forwardly in preparation for engagement with the side wall upper surfaces 10 of the adjacent gondola car 12.

The front boom arms 25 are lowered and the front supportive foot engaged with the upper surfaces 10 of the side walls 7 adjacent the end wall 8 of the adjoining gondola car 12. The rear boom structure 43 is folded forwardly as previously described and the grapple 56 engaged with the car bottom surface 120 in preparation for moving the apparatus forwardly. Further downward movement of the front boom arms 25 and rotation of the bucket 35 rearwardly elevates the apparatus 1 above the side walls 7 and moves the apparatus 1 forwardly. Simultaneously, the rear boom structure 43 is unfolded to lift the rear end 18 of the apparatus 1 and move the same forwardly and into position spanning the respective end walls 9 and 8 of the two gondola cars 6 and 12.

The operator continues loading and unloading operations, moving the apparatus 1 along the respective car rails 10 of the end-to-end gondola cars 6 and 12 until the rear supportive feet 110 and 111 reach the end wall 9 of the gondola car 6. Then, the rear boom structure 43 is folded and positioned on the car bottom surface 120 so that the grapple 56 is adjacent and aligned with the apparatus rear end 18. The rear boom structure 43 is unfolded to simultaneously lift the rear end 18 and disengage the rear supportive feet 110 and 111 from the side walls 7 of the first gondola car 6 and lift the rear end 18 over the separation between the end-to-end gondola cars 6 and 12 until the rear supportive feet 110 and 111 are shifted over the first end wall 8 of the second gondola car 12. The rear boom structure 43 is then raised to lower the apparatus 1 until the rear support feet 110 and 111 engage the upper surfaces 10 of the second car side walls 7, thereby transferring the apparatus 1 from one gondola car to another. For an operator familiar with the above procedures, this is a relatively simple maneuver and can be accomplished quickly, even while the train is slowly moving.

To remove the apparatus 1 from atop the gondola car, the direction of movement of the apparatus 1 is reversed and the same moved rearwardly by alternately unfolding the rear boom arm 43, engaging the bottom 120 of the gondola car 6 and then folding the same to pull the apparatus 1 rearwardly. The apparatus 1 is shifted from car to car if necessary, reversing the transfer procedure described above, until the end 8 of the last car is reached, that is: the starting point where the apparatus 1 climbed atop the car 6. The operator of the apparatus 1 then reverses the above described upward climbing procedure to remove the apparatus 1 from atop the car 6.

First, the rear boom structure 43 is unfolded and the grapple 56 engaged with the ground longitudinally adjacent the car end wall 8. The boom structure 43 is partially folded and the front boom arms 25 lowered to disengage the front and rear supportive feet 70, 110 and 111 from the sidewall upper surfaces 10 and remove the apparatus 1 from atop the car 6. The apparatus 1 is then lowered to the ground by further folding the rear boom structure 43 and raising the front boom arms 25.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A mobile apparatus for loading and unloading an open top railroad car and the like having spaced, parallel side walls with upper surfaces, said apparatus comprising:

(a) a mobile, powered apparatus having front and rear ends and front and rear wheels movable over ground surface;

(b) a power actuated front boom structure pivotally mounted at said apparatus front end, said front boom structure being of a length to reach below ground surface when said apparatus is positioned on the ground surface for elevating said front wheels above said ground surface and including a front supportive foot member having surfaces engageable with said side wall upper surfaces for supporting said apparatus front end thereon and including lateral movement limiting arm members extending therefrom and engageable with side surfaces of said side walls;

(c) power actuated, outwardly swingable outrigger arms pivotally connected adjacent to said apparatus rear end and movable toward said side wall upper surfaces, said outrigger arms including free ends having rear supportive foot members engageable with said side wall upper surfaces for supporting said apparatus rear end thereon and respectively including lateral movement limiting arm members extending therefrom and engageable with side surfaces of said side walls; and (d) a power actuated rear boom structure pivotally mounted at said apparatus rear end and being of a combined length to reach the ground surface when said apparatus is positioned on the upper surfaces of said side walls, said rear boom structure having respective arm lengths with a material engaging device connected thereto and operable to handle materials for loading and unloading operations relative to said railroad car when said apparatus is positioned upon the upper surfaces of the railroad car side walls.

2. The apparatus set forth in claim 1 including:

(a) power actuated linkage means extending between said front supportive foot member and said front boom structure and permitting forward and rearward tilting of said front supportive foot relative to said front boom structure.

3. The apparatus set forth in claim 1 wherein:

(a) said front supportive foot member includes opposite end portions having rounded bottom members engageable with said side wall upper surfaces for sliding and limited rolling movement thereon.

4. The apparatus set forth in claim 1 wherein:

(a) said front supportive foot member includes opposite end portions engageable with said side wall upper surfaces and a central beam member connecting said opposite end portions; said opposite end portions including (b) means rigidly and detachably mounting same to said central beam member, thereby permitting removal of said opposite end portions from said central beam member when transporting said apparatus on roads.

5. The apparatus set forth in claim 4 wherein:

(a) said lateral movement limiting arm members of said front supportive foot member are respectively connected to said opposite end portions and extend downwardly therefrom.

6. The apparatus set forth in claim 1 wherein:

(a) said front boom structure is of a length to reach above the side wall upper surfaces when said apparatus is positioned on the ground surface adjacent said side wall for engaging said front supportive foot member with the upper surfaces of said side wall and raising said apparatus front end relative thereto.

7. The apparatus set forth in claim 1 wherein:

(a) said rear supportive foot members include side wall upper surface engaging members having forwardly projecting, upwardly inclined leading edges facilitating sliding of said rear supportive foot members on said side wall upper surfaces.

8. The apparatus set forth in claim 1 wherein:

(a) said rear supportive foot members include outer edges and said lateral movement limiting arm members are connected to said outer edges and extend downwardly therefrom.

9. The apparatus set forth in claim 1 including:

(a) winch means connected to said apparatus front end and operable to draw said apparatus along the length of said railroad car when said apparatus is positioned atop the upper surfaces of said side walls.

10. The apparatus set forth in claim 1 wherein:

(a) said material engaging device includes a grapple having power actuated claws for handling materials.

* * * * *